US007023135B2

(12) United States Patent
Lee

(10) Patent No.: US 7,023,135 B2
(45) Date of Patent: Apr. 4, 2006

(54) LOWER SUBSTRATE OF A PLASMA DISPLAY PANEL AND METHOD OF MANUFACTURING THE SAME

(75) Inventor: Myung-Won Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 102 days.

(21) Appl. No.: 10/114,917

(22) Filed: Apr. 1, 2002

(65) Prior Publication Data

US 2002/0168914 A1 Nov. 14, 2002

(30) Foreign Application Priority Data

Apr. 2, 2001 (KR) ..... 2001-17475

(51) Int. Cl.
*H01J 17/49* (2006.01)

(52) U.S. Cl. ..... 313/582; 313/586; 313/587; 445/24

(58) Field of Classification Search ..... 313/582–587; 445/24

See application file for complete search history.

(56) References Cited

U.S. PATENT DOCUMENTS 5,747,931 A * 5/1998 Riddle et al. ..... 313/581
5,866,240 A * 2/1999 Prabhu et al. ..... 428/210
6,140,759 A * 10/2000 Sreeram et al. ..... 313/493
6,149,482 A * 11/2000 Sakasegawa et al. ..... 445/24

FOREIGN PATENT DOCUMENTS

JP 11219659 8/1999
JP 11288662 10/1999
JP 2000-067760 3/2000
JP 2000067760 3/2000
JP P2000-127630 A 5/2000

OTHER PUBLICATIONS

W-S Jang et al., XP-001068378, *50.1:A New Low-Cost Process for Fabricating a Plasma Display Back Panel*, 1036 SID 99 Digest, pp. 1036-1039.
June Dong Kim, XP-002262812, *8.1: LTCC-M Technology for PDP Back Panel*, P.D. May 9, 2000, pp. 121-124.
Y.H. Park, J.D. Mun et al., *31.2: Fabricating of 165 μm Pitched PDP Back Panel Based on LTCC-M Technology*, SID 00 Digest, pp. 1-4.

* cited by examiner

*Primary Examiner*—Mariceli Santiago
(74) *Attorney, Agent, or Firm*—Lee, Hong, Degerman, Kang & Schmadeka

(57) ABSTRACT

A method of fabricating a lower substrate of a Plasma Display Panel (PDP) includes the steps of preparing a secondary green sheet having larger amount than a first green sheet containing organic material, combining the first and second green sheets on the metal substrate by laminating the sheets, forming an electrode on the second green sheet, forming an electrode passivation layer on the second green sheet and shaping a separating wall by pressurizing the first and second green sheets to be metallic pattern having a groove.

30 Claims, 7 Drawing Sheets

LOWER SUBSTRATE OF A PLASMA DISPLAY PANEL AND METHOD OF MANUFACTURING THE SAME

CROSS-REFERENCE TO RELATED APPLICATIONS

Pursuant to 35 U.S.C. § 119(a), this application claims the benefit of earlier filing date and right of priority to the Korean Application No. 2001-17475, filed on Apr. 2, 2001, the content of which is hereby incorporated by reference herein in its entirety.

BACKGROUND OF THE INVENTION

1. Field of the Invention

The present invention relates to a method of fabricating a lower substrate of a Plasma Display Panel (PDP) and particularly, to a method of fabricating a lower substrate of a plasma display panel capable of easily forming a separating wall of a high aspect ratio and preventing formation of air layer between a green sheet and substrate and generation of cracks between separating walls.

2. Description of the Background Art

Generally, a PDP is a flat panel display device for displaying images such as letters or graphics by emitting a fluorescent substance by 147 nm of ultraviolet ray generated in discharging He+Xe or Ne+Xe gas. Such PDP can be easily made as a thin film and large screen and accordingly, recently, technology for improving the picture quality is rapidly developed.

FIG. 1 is a perspective view showing a plane discharging type PDP in the conventional alternate current driving mode. As shown in the drawing, the PDP includes a lower glass substrate 14 having an address electrode 2 and an upper glass substrate 16 having a couple of electrodes 4. A separating wall 8 for separating a dielectric layer and discharging cell is formed on the lower substrate 14 and fluorescent substance 6 for generating a visible ray by being emitted by ultraviolet ray generated in plasma discharging is coated on the surface of the dielectric layer 18 and separating wall 9.

The dielectric layer 12 and passivation layer 10 are formed in order on the upper glass substrate. The dielectric layer 12 stores wall charge in plasma discharging and the passivation layer 10 protects the couple of electrodes 4 and dielectric layer 12 against sputtering of gas in plasma discharging and increase emitting efficiency of a secondary battery. Mixed gas of He+Xe or Ne+Xe is injected and sealed to each discharging cell.

The separating wall 8 for preventing electric and optical crosstalk among discharging cells is the most important factor for determining displaying quality and emitting efficiency of the PDP and accordingly, as the panel of the PDP becomes larger and highly finer, much study about the separating wall is performed. Conventionally, there are several applied methods for fabricating the separating wall, such as screen printing method, sand blasting method, additive method, photo-sensitive paste method, Low Temperature Cofired Ceramic on Metal (LTCCM) method and the like.

The screen printing method has an advantage that the process is simple and the cost is low. However, the screen and glass substrate 14 must be arrayed at every printing time and printing and drying of a glass paste must be repeated several times. Also, in case the screen and the glass substrate is wrongly arrayed, since the separating wall transforms, precision of the separating wall is lowered.

The sand blasting method has an advantage that the separating wall can be formed on a large substrate. However, since much amount of glass paste is removed by grinder (namely, grains of sand) in the sand blasting method, material is wasted, thus to increase the fabrication cost. Moreover, the method has a disadvantage that the glass substrate 14 can be cracked or damaged by the impact occurred by the grinder.

The additive method is also appropriate to form a separating wall on the large substrate, but there occurs a problem that the separating wall is broken (damaged) when the residual substance is generated or the separating wall is generated since the photo-resist and the glass paste are not easily separated.

In the photo-sensitive paste method, the used photo-sensitive paste costs much and it is difficult to expose the lower portion of the photo-sensitive paste.

Compared with the above described methods, since the LTCCM method is simple and fabrication of the separating wall with high precision and high ratio, recently, the method is most widely used.

FIGS. 2A to 2G are views showing a lower substrate of the conventional plasma display panel using the Low Temperature Cofired Ceramic on Metal (LTCCM) method. Firstly, as shown in FIG. 2A, the green sheet 30 is fabricated. The green sheet is fabricated by positioning a slurry containing glass powder, organic solution, plasticizer, bond, additive and the like at a predetermined rate on a polyester film, forming the slurry in the shape of a sheet by a doctor blading process and then drying the resultant material.

As shown in FIG. 2B, the green sheet 30 is laminated-combined with the substrate 32. The substrate 32 is composed of glass, glass-ceramic, ceramic, metal and the like. Here, as metal used as material of the substrate 32, titanium is mainly used. Since titanium has higher strength than the substrate made of glass or ceramic material and higher heat-resistant temperature, with titanium, the substrate can be fabricated thinner than the substrate made of another substance such as glass or ceramic material and mechanical transformation can be minimized. Also, since titanium has high reflectibility, emitting efficiency and brightness can be increased by reflecting a visible ray back scattered to the side of the displaying surface.

In case the material of the substrate 32 is metal, it is desirable that fine glass powder is injected on the substrate 32 in the dry process or wet process before combining the substrate 32 and green sheet 30 so that the combination between the metal surface and green sheet 30 is easy. The injected fine powder is heated at the temperature of about 500 to 600° C. and fused and attached. The green sheet 30 is combined by laminating on the fused and attached metal substrate 32 on which the glass powder is fused and attached.

Then, as shown in FIG. 2C, the address electrode 2 is printed on the green sheet 30 and is dried.

As shown in FIG. 2D, the electrode passivation layer 36 is formed by drying the dielectric slurry after printing the slurry. Then, the substrate is heated, to under the softing point of organic material used as additive, for instance, polyvinylbutiral (PVB) to improve fluidity of the green sheet 30 combined to the substrate 32, after performing secondary laminating process to improve adhesive force between the green sheet 30 and electrode passivation layer 36.

Under the condition that the fluidity of the green sheet 30 is increased, after arraying metallic pattern 38 where a groove 38*a* is formed as shown in FIG. 2E, the substrate 32 is pressurized in the metallic pattern 38 with the pressure higher than about 150 kgf/cm2 as shown in FIG. 2F. By such pressurization, the green sheet 30 and electrode passivation layer 36 move into the groove 38*a* of the metallic pattern and rise up, thus to form a separating wall.

Then, as shown in FIG. 2G, the separating wall is plasticized by the heating, maintaining and cooling processes of the green sheet 30 and electrode passivation layer 36 after separating the metallic pattern 38 from the substrate 32. In the plasticizing process, organic material in the green sheet 30 is burned out by heat and crystalline nuclear is generated and grown up in inorganic material at a higher temperature than the burn-out temperature.

After plasticizing the separating wall, reflecting material such as $TiO_2$ is printed on the electrode passivation layer 36 and plasticized before printing the fluorescent substance 6.

As described above, with the LTCCM method, the process can be simple and separating wall can be formed in high precision. However, in the LTCCM method, formation of the separating wall 8 in the high aspect rate having larger height than the width is difficult and the green sheet 30 protruded in the shape of the separating wall is torn in separating the metallic pattern 38 and green sheet 30 or an air layer is generated between the substrate 32 and the green sheet 30 in forming by pressurizing. Such problem is caused by organic material contained in the green sheet 30. In case the amount of organic material in the green sheet 30 is large, the fluidity of the green sheet 30 is improved, but the height of the shaped separating wall is lowered again when the organic material is burnt out in plasticizing the green sheet 30 and the electrode passivation layer 36 after moving the organic material having higher fluidity into the groove 38*a* of the metallic pattern in forming the separating wall. Also, the portion protruded into the shaped separating wall 8 (upper portion of the separating wall) is torn in separating the metallic pattern 38 and green sheet 30.

On the other hand, since the fluidity of the green sheet 30 is low in case the amount of the contained organic material in the green sheet 30 is small, movement of the green sheet 30 into the groove of the metallic pattern 38*a* is difficult and accordingly, the separating wall can not be formed.

Also, with the conventional method of fabricating the separating wall using the LTCCM method, the air layer 40 is generated between the green sheet 32 and substrate 30 by difference of frictional force in shaping the wall as shown in FIG. 3. Such air layer 40 lowers strength of the separating wall 8 and causes leakage of gas. The difference of interfacial frictional force between the green sheet 32 and substrate 30 causes generation of cracks 42 among the separating walls as shown in FIG. 4 since the adjacent separating walls 8 move in the different direction.

SUMMARY OF THE INVENTION

Therefore, the present invention provides a method of fabricating a lower substrate of a Plasma Display Panel (PDP) capable of easily forming a separating wall of a high aspect rate and preventing generation of air layer between a green sheet and substrate in forming a separating wall and cracks on the green sheet between adjacent separating walls.

To achieve these and other advantages and in accordance with the purpose of the present invention, as embodied and broadly described herein, there is provided a method of fabricating a lower substrate of a plasma display panel, including the steps of preparing a secondary green sheet having larger amount than a first green sheet containing organic material, combining the first and second green sheets on the metal substrate by laminating the sheets, forming an electrode on the second green sheet, forming an electrode passivation layer on the second green sheet and shaping a separating wall by pressurizing the first and second green sheets to be metallic pattern having a groove.

The first green sheet can be solidly combined with a metal substrate since relatively small organic material is contained and the second green sheet can be easily moved by a small pressure in forming the separating wall since large amount of organic material is contained in the second green sheet.

About 5 to 15% of organic material and 85 to 95% of glass powder are mixed on the first green sheet and 15 to 30% of organic material and 70 to 85% of glass powder are mixed on the second green sheet. The organic material includes butylbenzylpthalate and polyvinylbutiral (PVB) and can include ethanol, methylethylketone and fish oil.

The foregoing and other, features, aspects and advantages of the present invention will become more apparent from the following detailed description when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
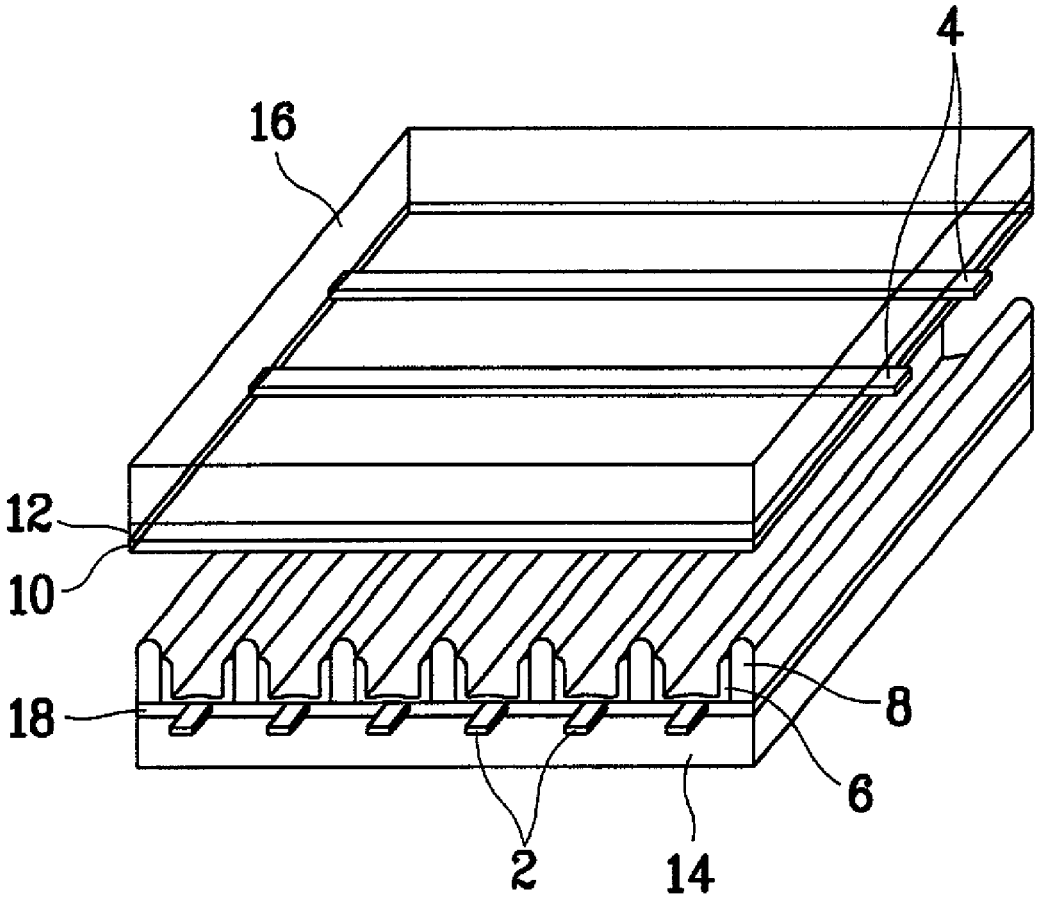
FIG. 1 PRIOR ART
FIG. 1 is a perspective view showing a plane discharging type plasma display panel in the conventional alternate current driving mode.
Figure 2A:
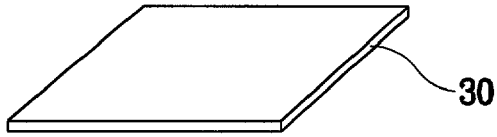
FIG. 2A PRIOR ART
FIGS. 2A to 2G are views showing a lower substrate of the conventional plasma display panel using the Low Temperature Cofired Ceramic on Metal (LTCCM) method.
Figure 2B:
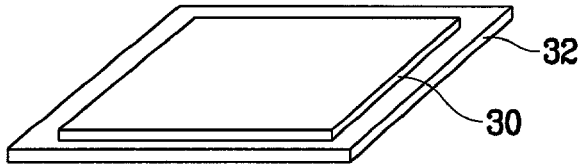
FIG. 2B PRIOR ART
Figure 2C:
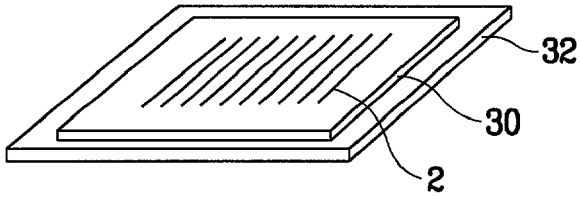
FIG. 2C PRIOR ART
Figure 2D:
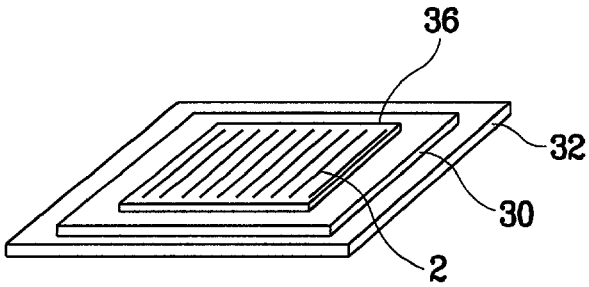
FIG. 2D PRIOR ART
Figure 2E:
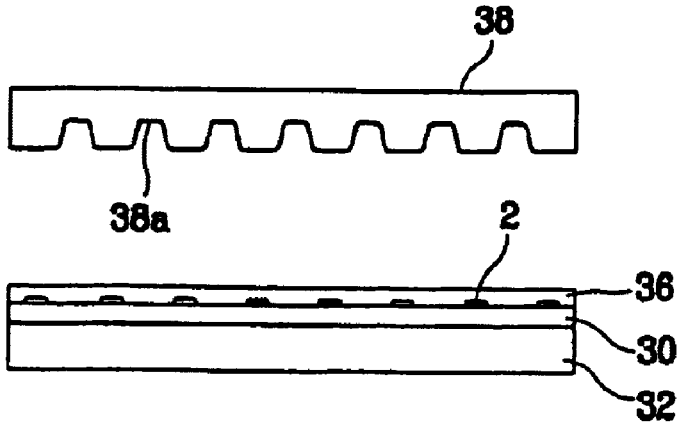
FIG. 2E PRIOR ART
Figure 2F:
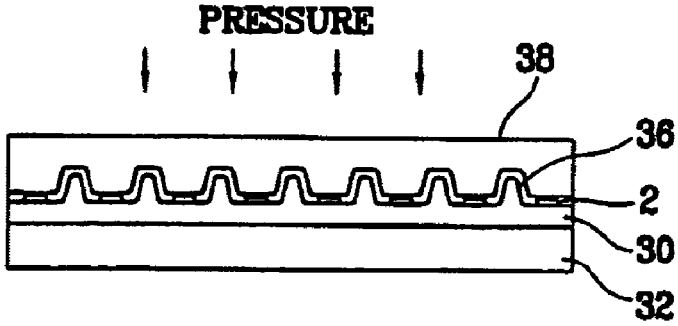
FIG. 2F PRIOR ART
Figure 2G:
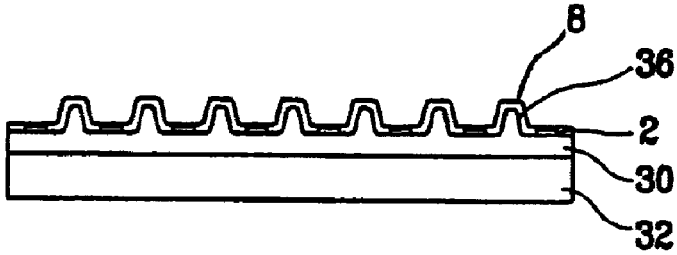
FIG. 2G PRIOR ART
Figure 3:
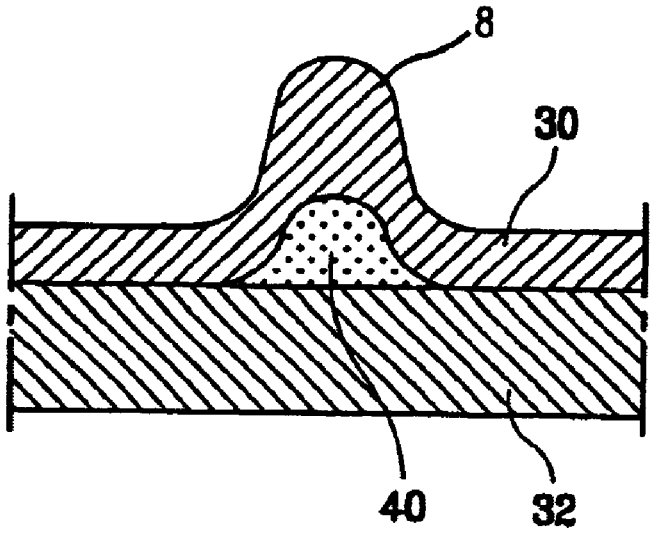
FIG. 3 PRIOR ART
FIG. 3 is a view showing the shape of an air layer under the separating wall in fabricating a lower substrate of the conventional plasma display panel using the LTCCM method.
Figure 4:
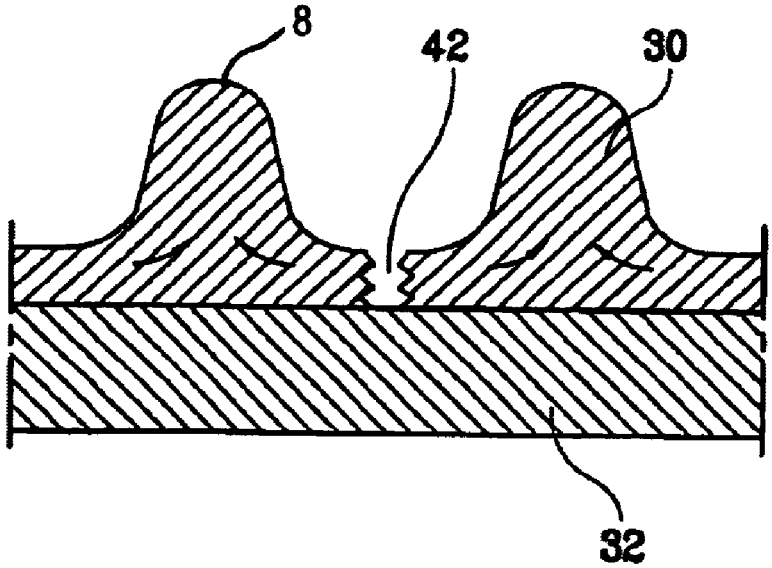
FIG. 4 PRIOR ART
FIG. 4 is a view showing the shape of a crack generated between separating walls in fabricating the lower substrate of the conventional plasma display panel using the LTCCM method.
Figure 5A:
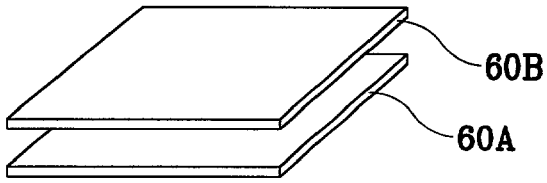
FIGS. 5A to 5G are views showing a method of fabricating a lower substrate of a plasma display panel in accordance with the present invention.

FIGS. 5A to 5G are views showing a method of fabricating a lower substrate of a plasma display panel in accordance with the present invention. Firstly, as shown in FIG. 5A, a first green sheet 60A and second green sheet 60B are fabricated. The second green sheet 60B is fabricated to shape a separating wall and the first green sheet 60A is fabricated to ease combining with the substrate made of metal and reduce difference of frictional force between a substrate and the second green sheet 60B in shaping the separating wall. Also, the first green sheet 60A is formed to support the separating wall so that the separating wall is not broken in shaping the separating wall.

As described above, the first green sheet 60A and the second green sheet 60B function differently because the sheets contain organic material in different amounts. The first green sheet 60A contains about 5 to 15% of organic material and 85 to 95% of glass powder, the organic materials including butylbenzylpthalate and polyvinylbutiral (PVB). The second green sheet contains more organic material than the first green sheet, for instance, about 15 to 30% of organic material and 70 to 85% of glass powder. Also, the organic material in the first green sheet 60A and the second green sheet 60B can include ethanol, methylethylketone (MEK), fish oil and the like.

The first green sheet 60A and second green sheet 60B is fabricated by forming a first slurry and second slurry containing the above described organic material, shaping in a sheet form by the doctor blading process under the condition that the first slurry and the second slurry are positioned on a polyester film and drying the resultant material.

Figure 5B:
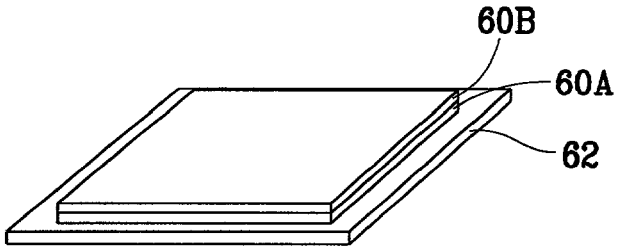

Then, as shown in FIG. 5B, fine glass powder is injected to the substrate 62 made of metal such as titanium and the powder is fused and attached on the surface of the substrate 62 by heating to about temperature of 500 to 600° C. The object that the glass powder is fused and attached on the substrate 62 is to improve adhesive force with the first green sheet connected to the substrate 62. As described above, the first green sheet 60A and second green sheet 60B are simultaneously laminated on the substrate on which the fine glass powder is fused and attached.

Figure 5C:
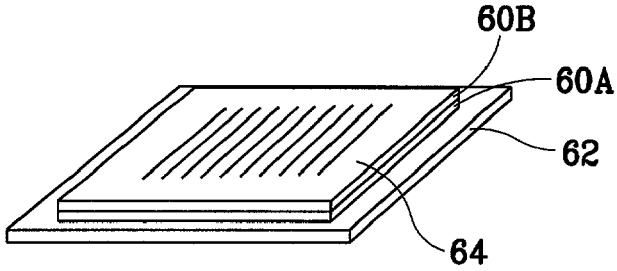
Figure 5D:
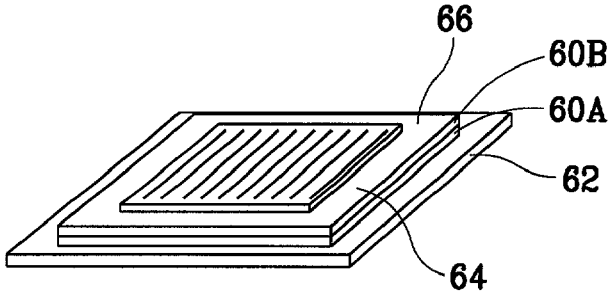

Then, as shown in FIG. 5C, an address electrode 64 is printed and dried on the second green sheet 60B.

As shown in FIG. 5C, the dielectric slurry is printed and dried on the whole substrate having the address electrode 64, thus to form an electrode passivation layer 66. The adhesive force of the second green sheet 60B and the electrode passivation layer 66 is improved by performing a second laminating process and the substrate 62 is heated to under the softing point of organic material to increase fluidity of the first green sheet 60A and second green sheet 60B attached to the substrate 62.

Figure 5E:
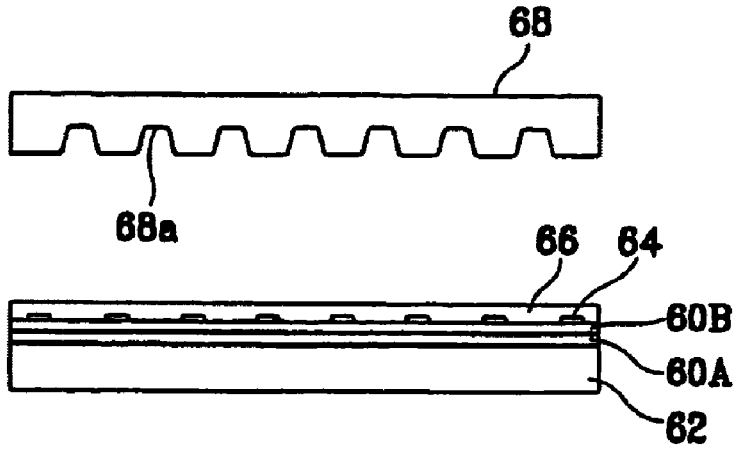
Figure 5F:
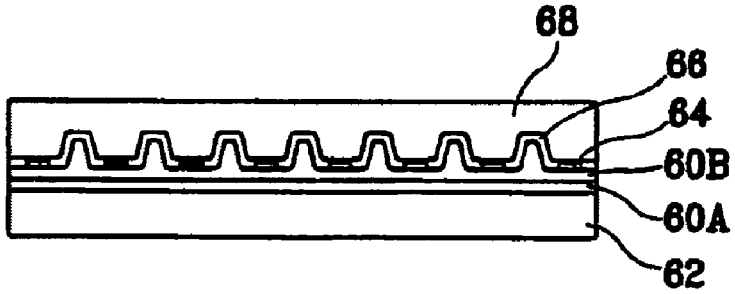

As described above, the metallic pattern 68 having a groove 68*a* for forming the separating wall is arrayed on the substrate 62 to which the first green sheet 60A and second green sheet 60B are attached as shown in FIG. 5E and the metallic pattern 68 is pressurized with a predetermined pressure on the substrate 62 as shown in FIG. 5F. The second green sheet 60B has higher fluidity due to having more organic material than the green sheet used in the conventional LTCCM method and accordingly, a preferred shape can be obtained by applying less pressure than in the conventional LTCCM method.

As the substrate 62 is pressurized by the metallic pattern, the separating wall 8 is formed by moving the second green sheet 60B and the electrode passivation layer 66 into the groove 68*a* in the metallic pattern. At this time, the first green sheet moves into the groove 68*a* having lower but almost same fluidity as that of the second green sheet 60B due to having smaller amount of organic material than the second green sheet 60B.

Figure 5G:
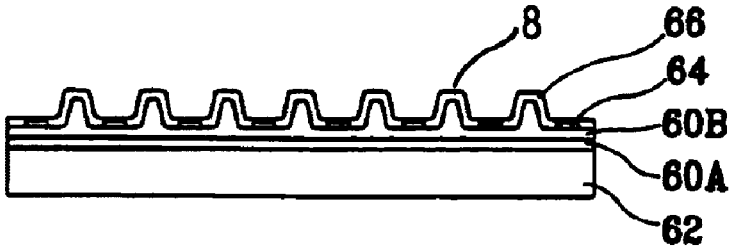
Figure 6:
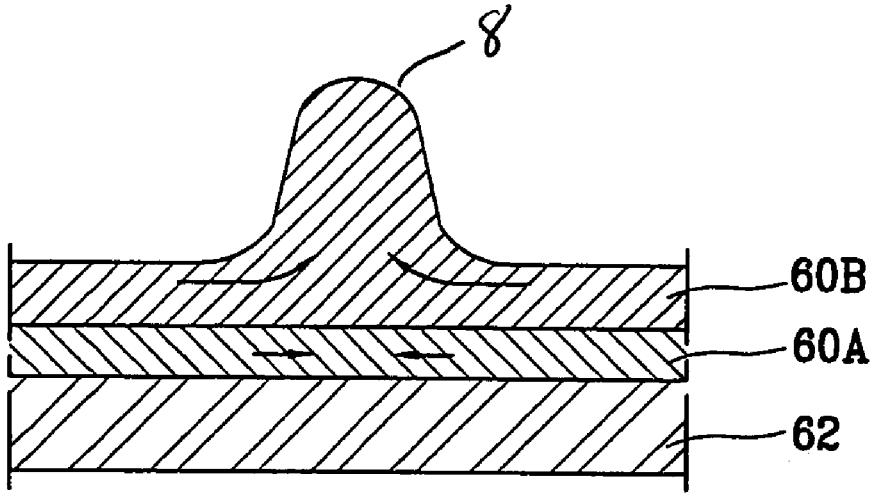
FIG. 6 is a cross-sectional view showing a step of restraining generating of an air layer in the method of fabricating the lower substrate of the plasma display panel in accordance with the present invention.

Then, as shown in FIG. 5G, the separating wall 8 is plasticized by heating, maintaining and cooling process after separating the metallic pattern 68 from the second green sheet 60B and the electrode passivation layer 66. The organic material contained in the first green sheet 60A and the second green sheet 60*b* is burnt out and crystalline nuclear is generated and grown up in inorganic material at a higher temperature than the burn-out temperature in the plasticizing process. The reflecting material such as $TiO_2$ is printed on the electrode passivation layer 66 and plasticized and the fluorescent substance 6 is printed.

Figure 7:
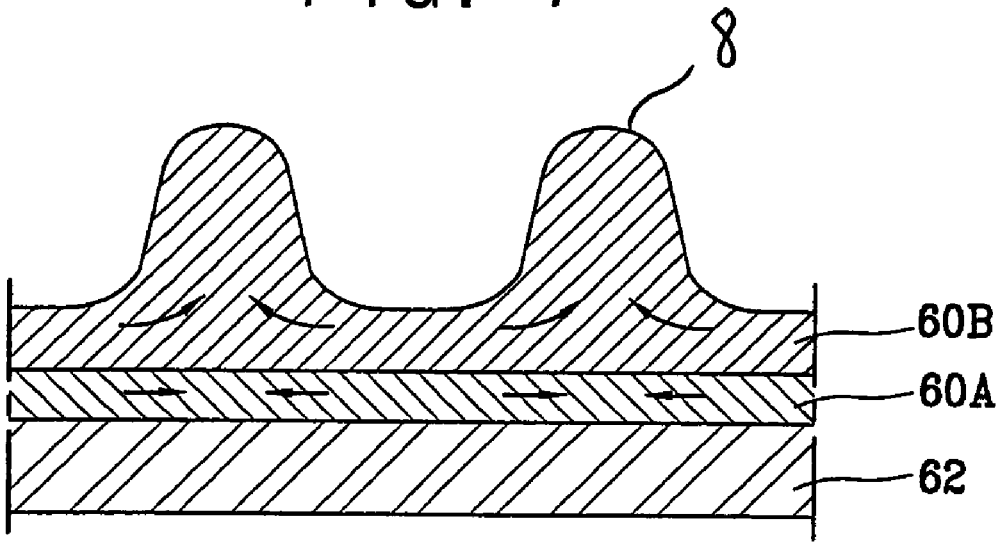
FIG. 7 is a cross-sectional view showing a step of restraining generating of the air layer in the method of fabricating the lower substrate of the plasma display panel in accordance with the present invention.

According to the method of fabricating the lower substrate of the PDP in accordance with the present invention, the friction between the first green sheet 60A and the second green sheet 60B in forming the separating wall is smaller and the friction between the first green sheet 60A and the substrate 62 in forming the separating wall also is smaller. Furthermore, the second green sheet 68B can move into the groove in the metallic pattern 68 with less pressure due to the smaller amount of organic material contained in the second green sheet 68B in forming the separating wall. Therefore, forming the separating wall 8 at a high rate is possible and generation of air layer between the first green sheet 60A and the second green sheet 60B or between the substrate 62 and the first green sheet 60A is prevented. Furthermore, as shown in FIG. 7, generation of a crack on the first green sheet 60A and the second green sheet 60B among adjacent separating walls is also prevented.

As described above, in the method of fabricating the lower substrate of the PDP in accordance with the present invention, the separating wall composed of the second green sheet is formed by connecting the first green sheet containing less organic material on the substrate and laminating the second green sheet having more organic material on the substrate. Therefore, with a relatively small pressure applied to the metallic pattern, the separating wall can be formed at a high rate by the second green sheet having higher fluidity. Furthermore, since the friction between the first green sheet and the second green sheet and between the first green sheet and the substrate is small, generation of air layer between the first green sheet and the second green sheet or between the substrate and the first green sheet can be prevented and generation of a crack on the green sheets among the adjacent separating walls can be prevented.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A method of fabricating a lower substrate of a plasma display panel, comprising:

preparing a second green sheet comprising a larger amount of organic material than a first green sheet comprising organic material;

combining the first and second green sheets on a metal substrate by laminating the sheets;

forming an electrode on the second green sheet;

forming an electrode passivation layer on the second green sheet; and forming a separating wall by pressurizing the first and second green sheets with a metallic pattern comprising at least one groove.

2. The method of claim 1, wherein the first green sheet is connected to the substrate.

3. The method of claim 1, wherein the first green sheet comprises about 5 to 15% of organic material and about 85 to 95% of glass powder.

4. The method of claim 1, wherein the second green sheet comprises about 15 to 30% of organic material and about 70 to 85% of glass powder.

5. The method of claim 1, wherein the organic material comprises butylbenzylpthalate and polyvinylbutiral (PVB).

6. The method of claim 1, wherein the organic material comprises one of ethanol, methylethylketone and fish oil.

7. The method of claim 1, wherein combining the first and second green sheets on the metal substrate comprises:

injecting glass powder onto the metal substrate;

fusing and attaching the glass powder to the surface of the metal substrate by heating the substrate where the glass powder is fused and attached; and laminating the first and second green sheets on the metal substrate to which the glass powder is fused and attached.

8. The method of claim 1, wherein forming the electrode passivation layer on the second green sheet comprises:

printing a dielectric slurry on the whole second green sheet where the electrode is formed; and drying the printed dielectric slurry.

9. The method of claim 1, wherein forming the separating wall comprises:

arraying the metallic pattern comprising at least one groove on the substrate to which the first and second green sheets are combined;

shaping the separating wall by moving the second green sheet into the at least one groove by pressurizing the second green sheet with the metallic pattern; and plasticizing the separating wall.

10. The method of claim 1, wherein the first and second green sheets are simultaneously laminated on the metal substrate.

11. A method of fabricating a lower substrate of a plasma display panel, wherein a green sheet comprising a two-layer structure comprising a first green sheet and a second green sheet, the second green sheet comprising more organic material than the first green sheet, is utilized to form a separating wall by pressurizing the two layers with a metallic pattern.

12. The method of claim 11, wherein the first green sheet comprises a first small amount of organic material and is connected to a substrate.

13. The method of claim 12, wherein the second green sheet comprises a second larger amount of organic material and is connected to the first green sheet.

14. The method of claim 11, further comprising:

combining the first and second green sheets on a metal substrate by laminating;

forming an electrode on the second green sheet;

patterning a dielectric layer on the second green sheet to cover the electrode;

forming the separating wall by pressurizing the metallic pattern on the dielectric layer of the second green sheet; and plasticizing the shaped wall.

15. The method of claim 14, wherein the first and second green sheets are simultaneously laminated on the metal substrate.

16. The method of claim 11, wherein the first green sheet comprises about 5 to 15% of organic material and about 85 to 95% of glass powder.

17. The method of claim 11, wherein the second greet sheet comprises about 15 to 30% of organic material and about 70 to 85% of glass powder.

18. The method of claim 11, wherein the organic material comprises butylbenzylpthalate and polyvinylbutiral (PVB).

19. The method of claim 11, wherein the organic material comprises one of ethanol, methylethylketone and fish oil.

20. The method of claim 11, wherein the metallic pattern comprises at least one groove.

21. A lower substrate of a plasma display panel, comprising: a first green sheet comprising organic material;

a second green sheet comprising a larger amount of organic material than the first green sheet and an electrode and electrode passivation layer formed thereon; and a metal substrate, wherein the first and second green sheets are combined and laminated on the metal substrate and a separating wall comprising at least one groove is formed thereon.

22. The lower substrate of claim 21, wherein the first green sheet is connected to the metal substrate.

23. The lower substrate of claim 21, wherein the first green sheet comprises about 5 to 15% of organic material and about 85 to 95% of glass powder.

24. The lower substrate of claim 21, wherein the second green sheet comprises about 15 to 30% of organic material and about 70 to 85% of glass powder.

25. The lower substrate of claim 21, wherein the organic material comprises butylbenzylpthalate and polyvinylbutiral (PVB).

26. The lower substrate of claim 21, wherein the organic material comprises one of ethanol, methylethylketone and fish oil.

27. The lower substrate of claim 21, further comprising glass powder injected onto the metal substrate and wherein the glass powder is fused and attached to the surface of the metal substrate by heating the substrate and the first and second green sheets are laminated on the metal substrate to which the glass powder is fused and attached.

28. The lower substrate of claim 21, wherein the electrode passivation layer comprises a dielectric slurry printed and dried on the second green sheet.

29. The lower substrate of claim 21, wherein the separating wall is plasticized.

30. The lower substrate of claim 21, wherein the metal substrate is formed by pressurizing the first and second green sheets with a metallic pattern comprising at least one groove.

* * * * *